United States Patent [19]

Cotton

[11] Patent Number: 4,524,338

[45] Date of Patent: Jun. 18, 1985

[54] GANGED CIRCUIT BREAKER ARRANGEMENT

[75] Inventor: John F. Cotton, Athens, Ga.

[73] Assignee: Westinghouse Electric Corp., Pittsburgh, Pa.

[21] Appl. No.: 576,681

[22] Filed: Feb. 3, 1984

[51] Int. Cl.[3] ..... H01H 77/02

[52] U.S. Cl. ..... 335/8; 337/37; 361/35; 74/471 R; 335/11

[58] Field of Search ..... 335/8, 9, 10, 11, 68, 335/106, 107; 337/3, 47, 37, 38, 41, 42; 74/471 R; 361/35, 36, 37, 38; 200/51.02

[56] References Cited

U.S. PATENT DOCUMENTS

| | | | |
|---|---|---|---|
| 2,686,242 | 8/1954 | Leonard et al. | 337/47 |
| 3,416,107 | 12/1968 | Anderson et al. | 335/11 |
| 3,883,781 | 5/1975 | Cotton | 361/37 |

*Primary Examiner*—E. A. Goldberg

*Assistant Examiner*—George Andrews

*Attorney, Agent, or Firm*—D. R. Lackey

[57] ABSTRACT

A ganged, multiple pole circuit breaker in which the multiple poles of each circuit breaker are mechanically related to a single operating point on the associated breaker. Their single operating points are pivotally related to a first common pivot point, which is fixed in relation to a common frame which supports both circuit breakers. Their single operating pivot points are additionally pivotally related to a second common pivot point. A guide arrangement, fixed to the common frame, guides the second common pivot point in a predetermined rectilinear path when actuated by an operating mechanism which includes a shaft arranged to extend through a transformer tank wall to a master operating handle. The guide arrangement prevents any motion of the second common pivot point in a direction lateral to the rectilinear path.

9 Claims, 5 Drawing Figures

GANGED CIRCUIT BREAKER ARRANGEMENT

BACKGROUND OF THE INVENTION

1. Field of the Invention

The invention relates in general to circuit interrupters or circuit breakers, and more specifically to arrangements for simultaneously operating a pair of multiple pole circuit breakers in synchronism.

2. Description of the Prior Art

It is common to protect oil-filled electrical distribution transformers against secondary short circuits and sustained heavy overloads by a secondary circuit breaker mounted under oil in the transformer tank. The bimetal of the circuit breaker is responsive to both current magnitude and oil temperature, thus protecting the transformer from sustained overloads, as well as excessive current. A magnetic trip may be used to instantaneously trip the circuit breaker in response to a short circuit condition.

Relatively low cost, high quality circuit breakers are available for transformer ratings up through 100 kVA, single phase at 240/120 volt secondary voltages. Occasionally there is a need for such secondary protection on transformers, both single phase and three phase, above 100 kVA. There is little incentive to develop oil circuit breakers of this rating for transformer use, however, because of the high development and tooling costs and the relatively low volume of transformers rated above 100 kVA requiring internal circuit breakers.

Two of the standard transformer circuit breakers connected in parallel would double the presently available maximum rating. While this is easy to accomplish electrically, successful parallel operation requires that the poles of both circuit breakers open and close simultaneously.

SUMMARY OF THE INVENTION

Briefly, the present invention is a ganged multiple pole circuit breaker arrangement for a transformer, and is specifically directed to a new and improved operating arrangement for simultaneously operating first and second similar multiple pole circuit breakers between their open and closed positions.

Standard oil circuit breakers available for transformer secondary protection include multiple poles, i.e., two circuit breakers for two wire, single phase, and three circuit breakers for three phase. The multiple poles are mechanically related to a single operating point or member, predetermined movement of which results in simultaneous operation of all poles between their open and closed positions.

In the present invention, two similar circuit breakers are mounted on a sturdy, common frame. Their single operating points are each pivotally linked via suitable levers to a first common pivot pin, with the position of the first common pivot pin being fixed. Their single operating points are additionally each pivotally linked via suitable levers or rods to a second common pivot pin. Guide means fixed to the common frame defines a predetermined rectilinear path which allows guided rectilinear movement of the second common pin, while preventing any lateral movement thereof. The axes of the first and second common pins are parallel, and the guided rectilinear movement of the second common pin directs the axis of the second common pin in a plane which includes the axis of the first common pin. An operating mechanism which includes a single operating shaft disposed through the transformer tank wall, is arranged to operate the second common pin in the rectilinear path in response to actuation of the master operating handle attached to the external end of the shaft.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
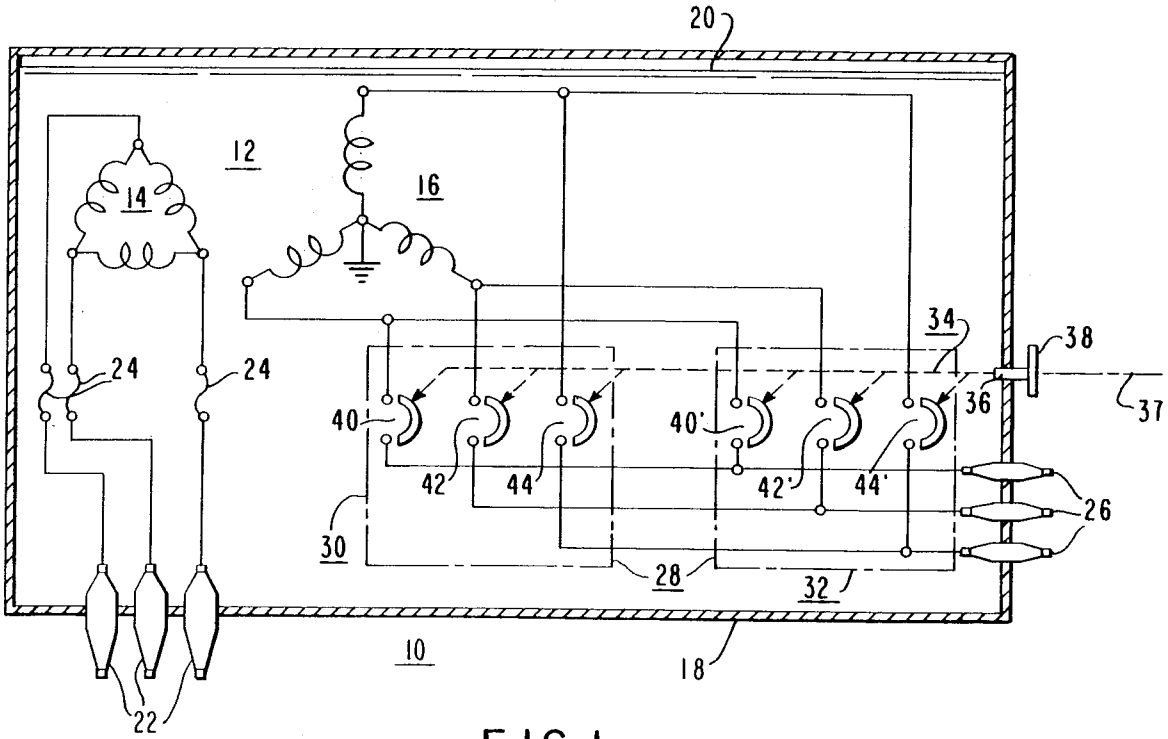
FIG. 1 is a schematic diagram of an oil-filled distribution transformer having ganged multiple pole circuit breakers which may be operated according to the teachings of the invention.

Referring now to the drawings, and to FIG. 1 in particular, there is shown a distribution transformer 10, such as a transformer of the pad-mount type. For purposes of example, transformer 10 is illustrated as being three phase, but it may be a single phase transformer, if desired. Transformer 10 includes a core-coil assembly 12, which includes primary and secondary windings 14 and 16, respectively. The primary and secondary windings may each be connected in either wye or delta, with delta and wye, respectively, being illustrated in the figure for purposes of example. The core-coil assembly 12 is disposed within a tank 18, and immersed in a liquid dielectric 20, such as mineral oil. The primary winding 14 is connected to high voltage bushings 22 disposed on the tank wall, either directly, or through fusible links 24, as illustrated. The secondary winding 16 is connected to low voltage bushings 26, which are also mounted on the tank wall, via a ganged circuit breaker arrangement 28 which includes first and second multiple pole circuit breakers 30 and 32. Individual circuit breakers suitable for each pole or phase, as well as arrangements for assembling the individual circuit breakers into a multiple pole circuit breaker, are shown in U.S. Pat. Nos. 2,686,242 and 3,883,781, which are assigned to the same assignee as the present application. A magnetic trip may be added to these breakers for instantaneous tripping on a short circuit condition. These patents are hereby incorporated into the specification of the present application by reference, and thus the circuit breakers 30 and 32 are not shown in detail. Circuit breakers 30 and 32, which are immersed in the liquid dielectric 20, are operated in synchronism via an operating arrangement 34 which may be constructed according to the teachings of the invention. Operating arrangement 34 includes an operating shaft 36 having an axis 37. Operating shaft 36 is common to both circuit breakers 30 and 32, with the operating shaft 36 extending from the circuit breakers through the wall of tank 18. A single master operating handle 38 is attached to shaft 36, outside of the tank 18.

Figure 3:
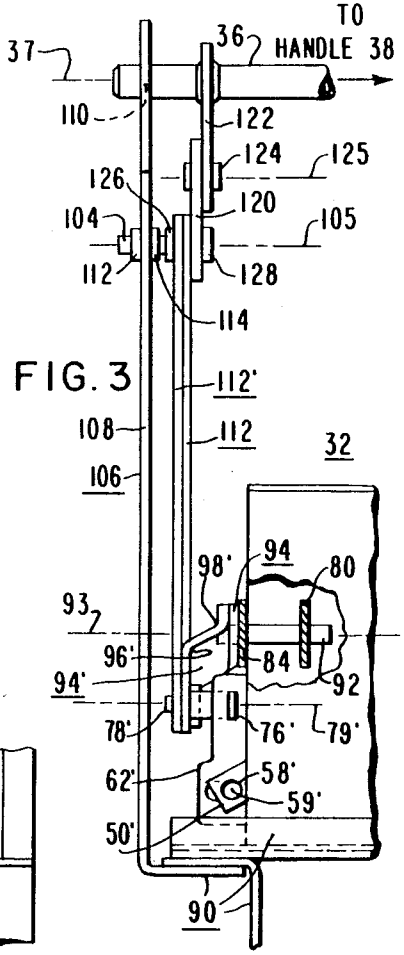
FIG. 3 is an end elevational view of the operating arrangement shown in FIG. 2.
Figure 2:
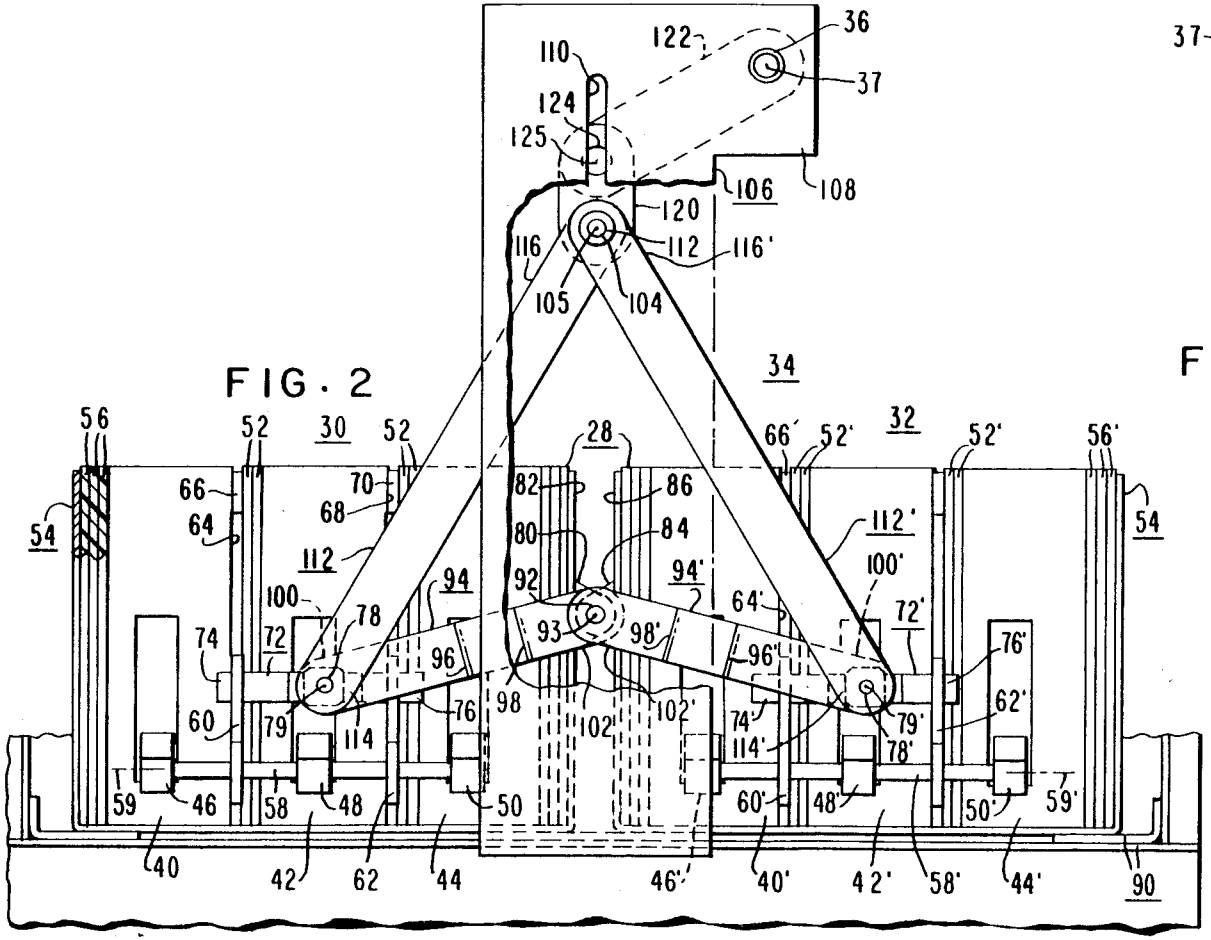
FIG. 2 is a front elevational view of an operating arrangement constructed according to the teachings of the invention, for operating two multiple pole circuit breakers, with this view illustrating the poles of the circuit breakers in their closed position.
Figure 5:
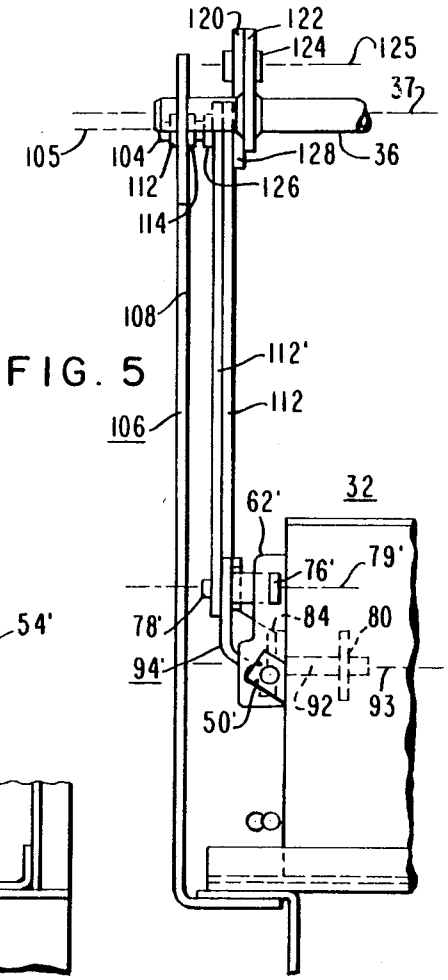
FIG. 5 is an end elevational view of the operating arrangement shown in FIG. 4.
Figure 4:
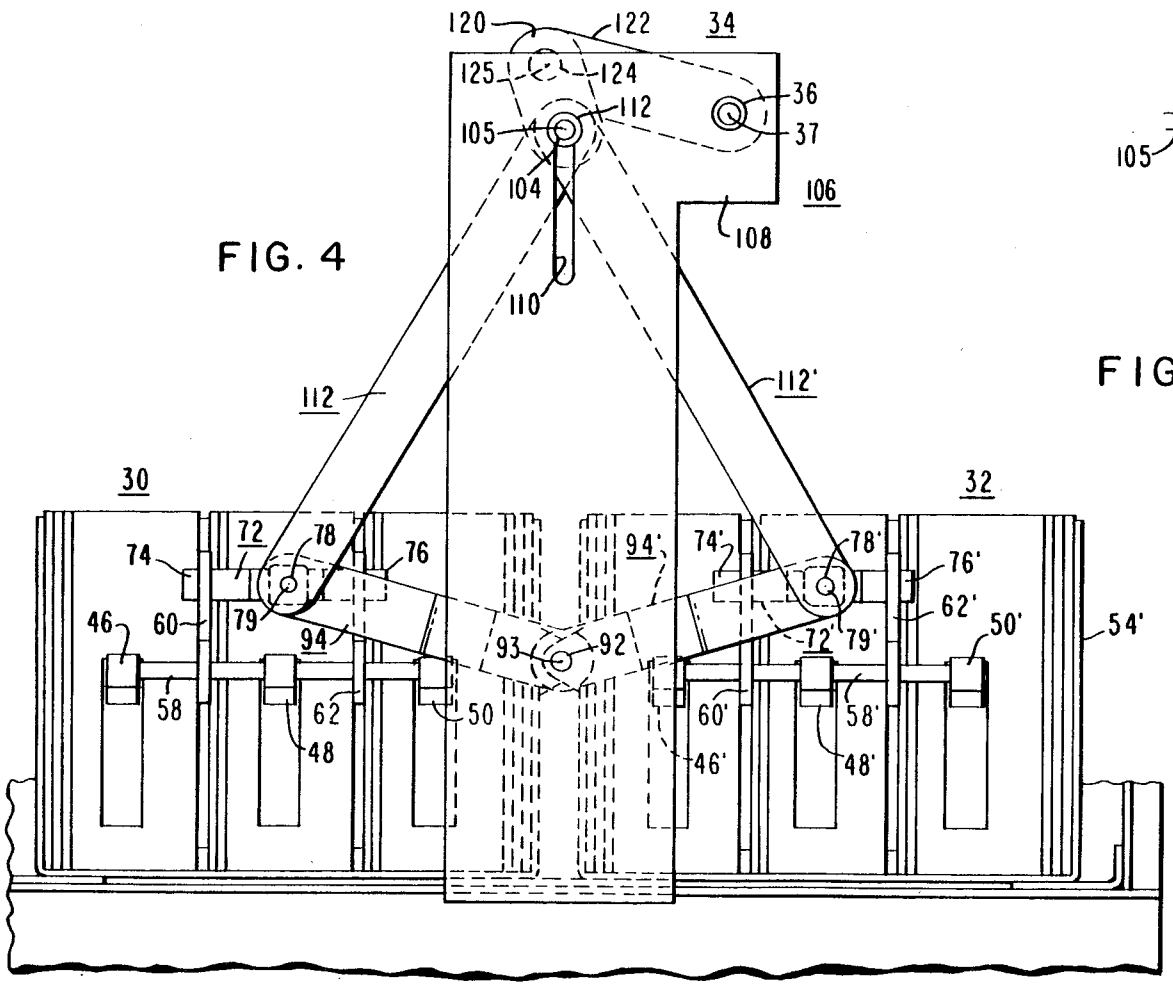
FIG. 4 is a front elevational view of the operating arrangement shown in FIG. 2, illustrating the poles of the circuit breakers in their open position.

FIGS. 2 and 3 are front and side elevational views of an operating arrangement 34 which may be used for the operating arrangement 34 shown schematically in FIG. 1. FIGS. 2 and 3 illustrate the circuit breakers 30 and 32 in their closed positions. FIGS. 4 and 5 are front and side elevational views similar to those of FIGS. 2 and 3, respectively, except illustrating the circuit breakers 30 and 32 in their open positions.

Multiple pole circuit breaker 30 includes three similar circuit breakers 40, 42 and 44 having operating handles 46, 48 and 50, respectively. Breakers 40, 42 and 44 are assembled in side-by-side relation, separated by a plurality of insulating spacer members, such as spacer members 52. A steel U-shaped frame 54 holds the individual circuit breakers in assembled relation, with additional insulating spacer members 56 being disposed between the leg portions of frame 54 and the sides of the outermost circuit breakers.

The handles 46, 48 and 50 of the circuit breakers are tied together via a rod 58 having an axis 59. Rod 58 passes through suitable openings disposed in their handles. The rod 58 also passes through openings in first and second spaced insulative lifter links 60 and 62, respectively. Lifter link 60 is disposed for slidable motion in a slot 64 formed between circuit breakers 40 and 42, such as by a suitable shaped spacer member 66. In like manner, lifter link 62 is disposed for slidable motion in a slot 68 formed by a spacer member 70 disposed between circuit breakers 42 and 44. A yoke member 72 having first and second outwardly extending arms 74 and 76, respectively, and a centrally disposed pivot pin 78 having an axis 79. Yoke member 72 is disposed to link both lifter links 60 and 62. Arm 74 of yoke member 72 extends through a slot in lifter link 60, and arm 76 of yoke 72 extends through a slot in lifter link 62. Pivot pin 78 functions as a single operating point which may be moved up or down to operate all of the breaker handles 46, 48 and 50 simultaneously, to manually close the circuit breakers to the position shown in FIGS. 2 and 3, and to manually open the circuit breakers to the position shown in FIGS. 4 and 5, as well as to manually reset the mechanisms of the circuit breakers following an automatic tripping operation. Also, an automatic trip of one breaker causes the tripping of the associated circuit breakers via the mechanical coupling provided by rod 58.

Multiple pole circuit breaker 32 is similar in construction to circuit breaker 30, with like reference numerals, except for a prime mark (') being used to identify like portions of circuit breaker 32.

When circuit breakers 30 and 32 are operated individually in a conventional manner, a lever having first and second ends and an intermediate opening for a pivot pin is provided. The breakers are available for both left-hand and right-hand operation. Breaker 30 is arranged for conventional right-hand operation, having an ear 80 fastened to the right-hand leg 82 of frame 54, with a pivot pin being fixed to the ear. The first end of the conventional operating lever is pivotally fixed to the yoke or operating pivot pin 78, its intermediate opening receives the pivot pin associated with ear 80, and the second end of the conventional operating lever is connected to an operating rod which extends through an opening in the transformer tank. Breaker 32 is arranged for conventional left-hand operation, similar in all respects to breaker 30 except it has an ear 84 fixed to the left-hand leg 86 of mounting frame 54. In the present invention, the conventional operating levers are not used. The right and left-hand multiple pole circuit breakers 30 and 32 are disposed in side-by-side relation on a rugged steel mounting frame 90 common to both circuit breakers 30 and 32, and the circuit breakers are mechanically fixed to this common frame with the openings in their right and left-hand ears 80 and 84 aligned. A single pivot pin 92 having an axis 93 is fixed in the aligned openings.

The pivot pins 78 and 78', which control the operation of all three poles of their associated multiple pole circuit breakers, are each pivotally related to the pivot pin 92, with pivot pin 92 being a first common pivot point for the two circuit breakers. This first common pivot point is a fixed pivot point. More specifically, pivot pin 78 of circuit breaker 30 is pivotally related to pivot pin 92 via a lever 94, suitably bent at 96 and 98 to cause its end portions 100 and 102 to lie in spaced parallel planes. End portion 100 has an opening for receiving pivot pin 78, and end portion 102 has an opening for receiving pivot pin 92. In like manner, pivot pin 78' of circuit breaker 32 is pivotally related to pivot pin 92 via a lever 94', suitably bent at 96' and 98' to cause its end portions 100' and 102' to lie in spaced parallel planes. End portion 100' has an opening for receiving pivot pin 78', and end portion 102' has an opening for receiving pivot pin 92.

Pivot pins 78 and 78' are additionally each pivotally related to a second common pivot point for the two circuit breakers. The second common pivot point is not a fixed point, but a point which is constrained by guide means for guided rectilinear movement. Movement of the second common pivot point in a direction lateral to the guided rectilinear path is prevented by the guide means. More specifically, the second common pivot point is provided by a pivot pin 104 having an axis 105. Pivot pin 104 is constrained for movement in a predetermined rectilinear path by guide means 106 such that axis 105 moves in a plane which includes the axis 93 of the first common pivot pin 92. Guide means 106 is a rugged steel angle member which is suitably fixed to mounting frame 90, such as by welding, with an upstanding flat, plate-like portion 108 of guide means 106 having an elongated slot 110 formed therein in which the pivot pin 104 is disposed. Pivot pin 104 includes first and second spaced members 112 and 114 fixed thereto, on each side of slot 110, with the diameters of these members being selected to exceed the slot width, to prevent any motion of pivot pin 104 in an axial direction. The sides of the slot 110 prevent any motion of pivot pin 104 in a direction transverse to the long dimension of the slot.

Pivot pins 78 and 78' are pivotally related to the second common point represented by pivot pin 104 via bridle rods 112 and 112', respectively. Bridle rod 112 has an opening adjacent to a first end 114 for receiving pivot pin 78, and an opening adjacent to a second end 116 for receiving pivot pin 104. In like manner, bridle rod 112' has an opening adjacent to a first end 114' for receiving pivot pin 78', and an opening adjacent to a second end 116' for receiving pivot pin 104.

A suitable operating arrangement for operating pivot pin 104 in its rectilinear path defined by slot 110 includes a link 120, a main operating rod link 122, and the main operating rod 36 shown schematically in FIG. 1, which extends through the wall of tank 18. The main operating rod 36 has one end disposed for rotation through an opening in the upstanding portion 108 of the mounting means 106, and the main operating rod link 122 has one end fixed to rod 36, such as by inserting rod 36 through a snug opening in link 122, and welding the link 122 to rod 36. The other end of link 122 is pivotally fixed to one end of link 120 via a pivot pin 124 having an axis 125, and the remaining end of link 120 is pivotally connected to pivot pin 104. Spacer members 126 and 128 are fixed to pivot pin 104 to maintain the assembled relationship of rods 112, 112' and line 120. Thus, rotation of rod 36 by master operating handle 38 in a counterclockwise direction, as viewed in FIG. 2, rotates lever 122 counterclockwise, driving link 120 downwardly, which drives pin 104 downwardly to the bottom of slot 110. Pivot pin 104 forces bridle rods 112 and 112' downwardly, yoke pivot pins 78 and 78' drive yokes 72 and 72' downwardly, lifter links 60, 62, 60' and 62' are all simultaneously driven downwardly in their associated slots, applying a uniform, simultaneous pressure to rods 58 and 58' which operate handles 46, 48, 50, 46', 48' and 50' simultaneously to cause the associated circuit breakers to operate to the closed position shown in FIGS. 2 and 3.

In like manner, rotation of operating rod 36 by the master operating handle 38 in a clockwise direction, as viewed in FIG. 2, rotates lever 122 clockwise, driving link 120 upwardly, which drives pin 104 upwardly to the top of slot 110. Pivot pin 104 pulls bridle rods 112 and 112' upwardly, yoke pivot pins 78 and 78' pull yokes 72 and 72' upwardly, lifter links 60, 62, 60' and 62' are all simultaneously driven upwardly in their associated slots applying a uniform simultaneous pressure to rods 58 and 58' which operate handles 46, 48, 50, 46', 48' and 50' simultaneously to the breaker-open position shown in FIGS. 4 and 5.

As shown in FIGS. 2 and 4, the means which pivotally relate the operating or yoke pivot pins 78 and 78' to the first and second common pivot points defined by pivot pins 92 and 104, respectively, cooperatively define a generally triangular configuration. Bridle rods 112 and 112' form two of the sides and links 94 and 94' define the remaining side. Links 94 and 94' define equal but opposite obtuse angles with pin 92 at the vertex, when circuit breakers 30 and 32 are in their open and closed positions.

Circuit breakers 30 and 32, when electrically connected in parallel as shown in FIG. 1, will also trip substantially simultaneously during an automatic trip operation. The trip of one breaker pole mechanically trips the associated breaker poles via the rod disposed through the breaker handles. This causes the current of the tripping poles to start to transfer to the other multiple pole circuit breaker, instantly causing this circuit breaker to also trip.

In summary, there has been disclosed a new and improved ganged, multiple pole circuit breaker which, with a relatively simple, low cost rugged operating mechanism insures positive, simultaneous closing and opening of all poles of the ganged breakers, while requiring little modification of the multiple pole circuit breakers from their form in which they are conventionally operated as single multiple pole breakers. The electrical parallel connections of the ganged breakers assures that all poles of the ganged breakers will open at substantially the same instant at any given overload or short circuit condition.

I claim as my invention:

1. A ganged, multiple pole circuit breaker arrangement, comprising:

first and second multiple pole circuit breakers, an operating pivot pin on each circuit breaker, predetermined movement of which results in the simultaneous operation of the associated poles between their open and closed positions, first means pivotally linking the operating pivot pins of said first and second circuit breakers to a first common pivot pin, with said first common pivot pin being fixed, second means pivotally linking the operating pivot pins of said first and second breakers to a second common pivot pin, third means mounting said second common pivot pin for movement in a predetermined guided rectilinear path while restraining it against lateral movement, said guided rectilinear movement directing the axis of the second common pivot pin in a plane which includes the axis of said first common pivot pin, and fourth means for operating said second common pivot pin in its guided rectilinear path, with such movement causing simultaneous movement of the operating pivot pins of the first and second circuit breakers in a path about the axis of said first common pivot pin.

2. The ganged circuit breaker arrangement of claim 1 wherein the first and second means define a generally triangular configuration, with the second means defining two of the sides thereof and with the first means defining the remaining side, with said remaining side including elements which define equal but opposite obtuse angles when the first and second circuit breakers are in their open and closed positions.

3. The ganged circuit breaker arrangement of claim 1 wherein each pole of each circuit breaker includes an operating handle, and each circuit breaker includes an operating rod which links the operating handles of all of the poles, at least two spaced lifter links engaging the operating handle, a yoke member having a centrally located pivot pin and arms which engage the lifter links, with said centrally located pivot pin being the operating pivot pin of the circuit breaker.

4. The ganged circuit breaker arrangement of claim 1 wherein the first means includes first and second links each having first and second ends, with the first ends of the first and second links being pivotally fixed to the operating pivot pins of the first and second circuit breakers, respectively, and with their second ends being pivotally fixed to the first common pivot pin.

5. The ganged circuit breaker arrangement of claim 1 wherein the second means includes first and second links each having first and second ends, with the first ends of the first and second links being pivotally fixed to the operating pivot pins of the first and second circuit breakers, respectively, and with their second ends being pivotally fixed to the second common pivot pin.

6. The ganged circuit breaker arrangement of claim 1 including a common frame on which the first and second circuit breakers are mounted, with the third means being fixed to said common frame.

7. The ganged circuit breaker arrangement of claim 1 wherein each pole of the first multiple pole circuit breaker is electrically connected in parallel with a selected pole of the second multiple pole circuit breaker.

8. A ganged, multiple pole circuit breaker arrangement, comprising:

first and second multiple pole circuit breakers, each of said circuit breakers including a predetermined number of single pole circuit breakers having operating handles joined by a common operating rod, first and second spaced lifter links coupled to the operating rod, and a yoke member having a centrally located yoke pivot pin and first and second outwardly extending arms engaged with the first and second lifting links, respectively, said first and second circuit breakers having right and left-hand pivot points, respectively, normally associated with right and left-hand operation of the yoke members, means including a common frame mounting said right and left-hand circuit breakers in side-by-side relation with their right and left-hand pivot points on a common axis, a first common pivot pin fixed coaxial with said common axis, first and second link members each having first ends pivotally fixed to the yoke pivot pins of the first and second circuit breakers, respectively, and second ends which are pivotally fixed to said first common pivot pin, a second common pivot pin, first and second bridle rods having first ends pivotally fixed to the yoke pivot pins of said first and second circuit breakers, respectively, and second ends pivotally linked to said second common pivot pin, means mounting and guiding said second common pivot pin for predetermined rectilinear movement while restraining any lateral movement thereof, whereby movement of said second common pivot pin in one guided direction will simultaneously operate the first and second circuit breakers to their open positions, and guided movement in the opposite direction will operate the first and second circuit breakers to their closed positions.

9. The ganged, multiple pole circuit breaker arrangement of claim 8 including means connecting each single pole circuit breaker of the first multiple pole circuit breaker in electrical parallel with a predetermined single pole circuit breaker of the second multiple pole circuit breaker.

* * * * *